United States Patent [19]

Wenger et al.

[11] Patent Number: 4,819,902

[45] Date of Patent: Apr. 11, 1989

[54] COLLAPSIBLE MUSIC STAND

[75] Inventors: Kari J. Wenger, Cincinnati, Ohio; Eugene N. Reshanov, Golden Valley, Minn.

[73] Assignee: Wenger Corporation, Owatonna, Minn.

[21] Appl. No.: 74,413

[22] Filed: Jul. 16, 1987

[51] Int. Cl.[4] ..... A47B 97/08

[52] U.S. Cl. ..... 248/460; 248/423; 248/454

[58] Field of Search ..... 298/460, 423, 170, 165, 298/188.7, 188.5, 188.2, 166, 150, 284, 121, 457, 454, 126, 463, 276, 442.2, 286; 40/610, 341

[56] References Cited

U.S. PATENT DOCUMENTS

| | | | |
|---|---|---|---|
| 568,139 | 9/1896 | Haynes | 248/457 |
| 856,679 | 6/1907 | Buckland | 248/460 |
| 1,384,861 | 7/1921 | Schingel | 248/454 |
| 2,653,781 | 9/1953 | Niemeier | 248/150 |
| 2,799,968 | 7/1957 | Wythe | 248/454 |
| 2,921,763 | 1/1960 | Miller et al. | 248/121 |
| 4,061,302 | 12/1977 | Boone | 248/188.1 X |
| 4,671,479 | 6/1987 | Johnson et al. | 248/188.7 X |

FOREIGN PATENT DOCUMENTS

| | | | |
|---|---|---|---|
| 120539 | 5/1901 | Fed. Rep. of Germany | 248/457 |
| 53740 | 2/1911 | Switzerland | 248/457 |
| 20550 | 9/1911 | United Kingdom | 248/457 |
| 396267 | 8/1933 | United Kingdom | 248/284 |

*Primary Examiner*—Robert W. Gibson, Jr.
*Assistant Examiner*—Karen J. Chotkowski
*Attorney, Agent, or Firm*—Dorsey & Whitney

[57] ABSTRACT

A music stand that can be collapsed into an easily transportable configuration is disclosed. The stand includes a telescoping stem supported in an upright position by a collapsible base. A music rack is attached to the stem by a support arm, enabling the rack to be pivoted relative to the stem about two, spaced apart, generally horizontal pivot axes.

18 Claims, 1 Drawing Sheet

COLLAPSIBLE MUSIC STAND

TECHNICAL FIELD

This invention relates to stands for supporting and displaying sheet music. In particular, it relates to a music stand that can be collapsed into an easily transportable configuration.

BACKGROUND ART

Performing musicians are frequently required to play short engagements at different locations. Instruments, music, music stands, and stage accessories must all be transported from one job location to another. Conventional music stands are difficult to transport due to their size and awkward weight distribution. Collapsbible music stands heretofore available have lacked the sturdiness required to support large books of music, and are lacking in visual stage appeal. A sturdy, attractive music stand that could be collapsed into an easily transportable configuration would be a decided advantage.

SUMMARY OF THE INVENTION

The collapsible music stand herein disclosed provides the performing musician with a sturdy, attractive music stand that can be quickly collapsed into an easily tranasportable configuration. The music stand includes a collapsible base assembly, an extensible support stem, and a full sized music rack. The music rack is pivotally mounted on a pair of support arms that are in turn pivotally mounted to the upright stem. The base assembly includes three support feet, one of which can be pivoted between an upright, stowed position, and a horizontal, extended position.

DETAILED DESCRIPTION OF THE DRAWING

Figures 1, 2, 3, 4, 5:
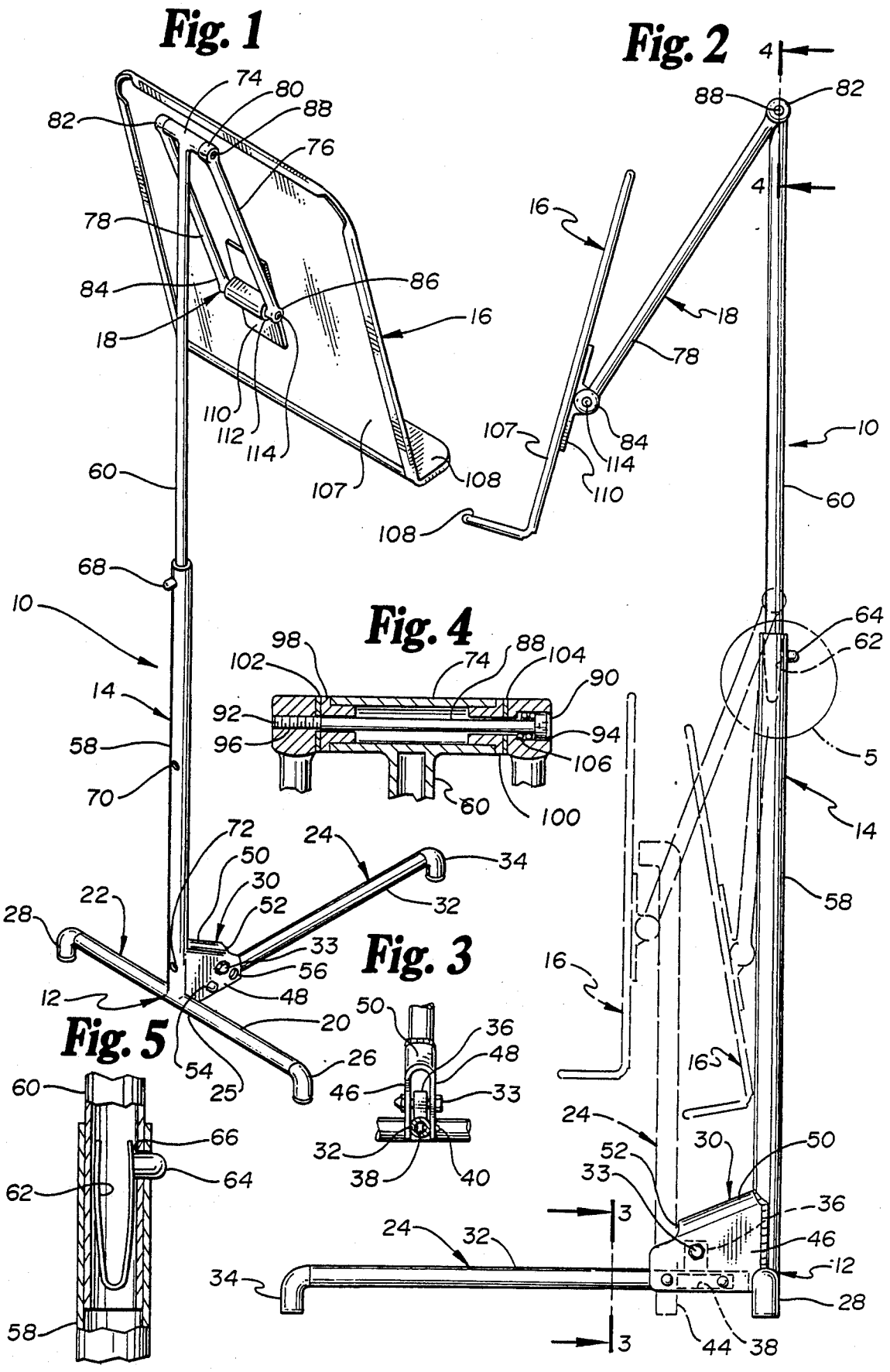
FIG. 1 is a perspective view of a music stand in accordance with the present invention.
FIG. 2 is a side, elevational view of a music stand in accordance with the present invention, with phantom lines depicting the music stand in two separate collapsed configurations.
FIG. 3 is a fragmentary, sectional view taken along line 3—3 of FIG. 2.
FIG. 4 is a fragmentary, sectional view taken along line 4—4 of FIG. 2.
FIG. 5 is a fragmentary, sectional view taken from the encircled area 5 of FIG. 2.

A music stand 10 in accordance with the present invention broadly includes base 12, upright support member 14, music rack 16, and music rack mounting element 18.

The base 12 includes fixed feet 20, 22 and retractable foot 24. The fixed feet 20, 22 comprise a single, horizontal, metal tube 25 fixedly attached to the upright support member 14. Downwardly extending, synthetic resin foot pads 26, 28 are attached at the end of each foot 20, 22.

Retractable foot 24 is pivotally coupled to upright support member 14 by bracket 30. Referring to FIG. 1 and FIG. 3, retractable foot 24 includes metal tube 32, plastic foot pad 34, and pivot lug 36. Leaf spring 38 with attached latch button 40 is carried within the metal tube 32. The retractable foot 24 is pivotally coupled to the bracket 30 by pivot bolt 33 received through pivot lug 36. As depicted by phantom lines in FIG. 2, the end portion 44 of retractable foot 24 extends beyond pivot lug 36 a distance approximately equal to the height of the plastic foot pads 26, 28.

Bracket 30 presents an inverted U-shape cross section formed by side plates 46, 48 and arcuate top wall 50. Recess 52 is provided in top wall 50. Foot extended latch hole 54 and foot stowed latch hole 56 are bored through bracket side plate 48.

The upright support member 14 is an extensible assembly made up of stem tube 58 and stem rod 60 shiftably received within stem tube 58. Leaf spring 62 with attached locking latch button 64 is received within stem rod 60, as best depicted in FIG. 5. The latch button 64 is received through stem rod aperture 66, and through a selected one of several stem tube latch button receiving apertures 68, 70, 72.

Stem rod 60 terminates at its upper end at stem tee 74. Stem tee 74 comprises a support tube for receiving music rack mounting element 18 about a first, generally horizontal pivot axis.

Mounting element 18 comprises opposed radial arms 76, 78. Radial arms 76, 78 each include a first end stem knuckle 80, 82, respectively, and an opposed, second end rack knuckle 84, 86, respectively. Referring to FIG. 4, a tightening bolt 88 is received through stem knuckle 80, stem tee 74, and stem knuckle 82 for attaching music rack mounting element 18 to upright support member 14. Tightening bolt 88 includes bolt head 90 and threaded end portion 92. Stem knuckle 80 includes bolt head receiving counterbore 94. Stem knuckle 82 includes tightening bolt receiving threaded channel 96. Bushings 98, 100 are received in opposed ends of stem tee 74. Friction washers 102, 104 are interposed between bushings 98, 100 and the stem knuckles 80, 82, respectively. Compression spring 106 is carried by tightening bolt 88 and is received within stem knuckle counterbore 94.

Music rack 16 includes back plate 107 and tray 108. Mounting bracket 110 fixedly attaches support tube 112 to the rear surface of music rack back plate 107. A tightening bolt 114 is received through rack knuckle 84, support tube 112, and rack knuckle 86 for attaching rack 16 to rack mounting element 18 along a second, generally horizontal pivot axis. The internal structure and assembly of parts within support tube 112 and rack knuckles 84, 86 are similar to the structure and assembly of parts described above in connection with the structure attaching the stem knuckles 80, 82 of radial arms 76, 78 to stem tee 74.

In operation, the music stand 10 is easily transported in one of its two collapsed configurations, as depicted by phantom lines in FIG. 2. In the first collapsed configuration, the music rack 16 is stowed between the upright support member 14 and the stowed retractable foot 24. In the second collapsed configuration, the retractable foot 24 is positioned between the music rack 16 and upright support member 14. The stem tee 74 provides a convenient carrying handle for the collapsed music stand. The foot pads 26, 28, together with retractable foot end portion 44, provide a three point base for temporarily supporting the collapsed music stand on a flat surface. Latch button 64 is received through stem tube aperture 72, locking the stem rod in its lowered position. Retractable foot latch button 40 is received through stowed latch hole 56, locking the retractable foot 24 in its stowed position.

The collapsed music stand 10 is easily assembled by first depressing latch button 40 and lowering retractable foot 24 into its extended position. Once in the extended position, the latch button 40 is snapably engaged into extended latch hole 54 of bracket 30. Latch button 64 of stem rod 60 is next depressed so as to disengage the latch button 64 from stem tube aperture 72. Stem rod 60 may then be raised upwardly, allowing latch button 64 to snapably engage stem tube aperture 70 or 72, depending on the desired height of the stem rod 60.

Radial arms 76, 78 are next rotated through an arcuate path of travel about the first, generally horizontal pivot axis, to position the music rack 16 outwardly from the upright support member 14. The frictional engagement of the stem knuckles 80, 82 of radial arms 76, 78 with stem tee 74 maintains the radial arms 76, 78 at the selected position relative to the upright support member 14. The tightness with which stem knuckles 80, 82 engage the stem tee 74 may be adjusted by rotating tightening bolt 88. Coil spring 106 applies biasing pressure against the bolt head of tightening bolt 88, thereby inhibiting the undesired rotation of the bolt 88.

The final step in setting up the music stand 10 is to rotate the music rack 16 about the second generally horizontal axis to position the music rack at a proper angle for supporting sheet music or the like. The frictional engagement of the rack knuckles 84, 86 of radial arms 76, 78 with support tube 112 of music rack 18 maintains the music rack 18 at the selected position relative to the radial arms 76, 78. The tightness with which rack knuckles 84, 86 engage the support tube 112 may be adjusted in the same manner as the tightness with which stem knuckles 80, 82 engage stem tee 74 may be adjusted.

We claim:

1. A collapsible stand for supporting and displaying sheet music or the like, comprising:

a generally upright support member having a generally vertical stem rod and a generally horizontal stem tee carried at the top of said stem rod, said stem tee extending radially outwardly to opposed sides of said stem rod at a distance sufficient to present a hand graspable stem tee handle;

a rack member adapted for carrying said sheet music or the like;

an elongated rack member mounting assembly having a first end and a second, opposed end;

first pivot means for pivotally coupling said rack member first end to said stem tee about a first, generally horizontal pivot axis; and second pivot means for pivotally coupling said rack member second end to said rack member about a second, generally horizontal pivot axis, said mounting assembly comprising first and second, spaced apart arms, each of said arms extending between said stem tee and said rack member, and each of said arms including a first end pivotally coupled to said stem tee by said first pivot means and a second end pivotally coupled to said rack member by said second pivot means, whereby said rack member can be shifted to a collapsed position abutting said stem rod without said arms coming into interfering contact with said stem rod and said stand can be easily lifted by said stem tee handle.

2. The apparatus as claimed in claim 1, said stem rod comprising an extensible assembly whereby the height of said support member can be selectively adjusted.

3. The apparatus as claimed in claim 2, said stem rod comprising a first stem rod element and a second stem rod element shiftably received by said first stem rod element, and means for selectively locking the position of said second stem rod element relative to said first stem rod element.

4. The apparatus as claimed in claim 1, including a base member operably coupled to said support member for maintaining said support member in a generally upright orientation.

5. The apparatus as claimed in claim 4, said base member including a first foot member pivotally coupled to said support member for selective shifting between a stored position and an extended position.

6. The apparatus as claimed in claim 4, said support member defining a generally vertical support member axis, said base member including second and third foot members fixedly coupled to said support member and oriented in a plane generally perpendicular to said support member axis.

7. The apparatus as claimed in claim 6, said second and third foot members being generally linearly aligned with each other and oriented generally perpendicular to said first foot member when said first foot member is in said extended position.

8. The appartaus as claimed in claim 1, said mounting assembly being shiftable through a mounting element arcuate path of travel about said first pivot axis, said stand further including mounting assembly positioning means for selectively maintaining said mounting assembly at a selected orientation relative to said support member along said mounting assembly path of travel.

9. The apparatus as claimed in claim 8, said mounting assembly positioning means including adjustable friction means for selectively frictionally coupling said arms to said stem tee.

10. The apparatus as claimed in claim 9, said stem tee comprising a support tube, said friction means including an elongated screw extending through one of said arms and said tube and threadably received by the other of said arms whereby said arms may be drawn together and clamped against said tube by tightening said screw.

11. The apparatus as claimed in claim 10, including means for inhibiting the threadable rotation of said screw.

12. The apparatus as claimed in claim 11, said means for inhibiting threadable rotation of said screw comprising a coil spring carried by said screw.

13. The apparatus as claimed in claim 1, said rack member shiftable through a rack member arcuate path of travel about said second pivot axis, said stand further including rack member positioning means operably coupled to said rack member for selectively maintaining said rack member at a selected orientation relative to said mounting assembly along said rack member path of travel.

14. The apparatus as claimed in claim 13, said rack member positioning means including adjustable friction means operably coupled to said mounting assembly for selectively frictionally coupling said rack member to said mounting assembly.

15. The apparatus as claimed in claim 14, said rack member including an arm receiving member interposed between the second ends of said arms, said friction means comprising means for urging said arms into frictional engagement with said arm receiving member.

16. The apparatus as claimed in claim 15, said arm receiving member comprising a support tube, said friction means including an elongated screw extending through one of said arms and said tube and threadably received by the other of said arms whereby said arms may be drawn together and clamped against said tube by tightening said screw.

17. The apparatus as claimed in claim 16, including means for inhibiting the threadable rotation of said screw.

18. The apparatus as claimed in claim 16, said means for inhibiting rotation of said screw comprising a coiled spring carried by said screw.

* * * * *

UNITED STATES PATENT AND TRADEMARK OFFICE

CERTIFICATE OF CORRECTION

PATENT NO. : 4,819,902

DATED : April 11, 1989

INVENTOR(S) : Kari G. Wenger et al.

It is certified that error appears in the above-identified patent and that said Letters Patent is hereby corrected as shown below:

Column 1, line 26, delete the word "tranasport-able" and substitute therefor --transport-able--.

Column 4, line 26, delete the word "appartaus" and substitute therefor --apparatus--

Column 3, line 50, delete the words "member first" and substitute therefor —member mounting assembly first—.

Column 3, line 53, delete the words "member second" and substitute therefor —member mounting assembly second—.

Signed and Sealed this

Seventh Day of December, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 4,819,902

DATED : April 11, 1989

INVENTOR(S) : Kari G. Wenger et al.

It is certified that error appears in the above-indentified patent and that said Letters Patent is hereby corrected as shown below:

Column 4, line 15, delete the number "4" and substitute therefor —5—.

Signed and Sealed this

Fourth Day of July, 199

Bruce Lehman

*Attest:*

BRUCE LEHMAN

*Attesting Officer*

*Commissioner of Patents and Trademarks*